US008721399B1

(12) United States Patent
Huber et al.

(10) Patent No.: US 8,721,399 B1
(45) Date of Patent: May 13, 2014

(54) MANUALLY OPERATED SHARPENER

(71) Applicant: Edgecraft Corporation, Avondale, PA (US)

(72) Inventors: Thomas M. Huber, Dover, DE (US); Daniel D. Friel, Jr., Kennett Square, PA (US); Samuel Weiner, Wilmington, DE (US); Cassandra Wilson Gluyas, Cape May Court House, NJ (US); Thomas Walter Gluyas, Cape May Court House, NJ (US)

(73) Assignee: Edgecraft Corporation, Avondale, PA (US)

( * ) Notice: Subject to any disclaimer, the term of this patent is extended or adjusted under 35 U.S.C. 154(b) by 0 days.

(21) Appl. No.: 14/094,852

(22) Filed: Dec. 3, 2013

Related U.S. Application Data

(62) Division of application No. 13/927,253, filed on Jun. 26, 2013.

(51) Int. Cl.
*B24B 3/52* (2006.01)
*B24B 3/54* (2006.01)
*B24D 15/08* (2006.01)

(52) U.S. Cl.
USPC ..... 451/349; 451/555; 451/558; 76/82.2

(58) Field of Classification Search
USPC ..... 451/344, 349, 552, 555, 558, 45, 57, 451/58, 65, 67, 259, 260, 262, 267, 282; 76/82, 82.2, 85; 7/170
See application file for complete search history.

(56) References Cited

U.S. PATENT DOCUMENTS

| | | | | | |
|---|---|---|---|---|---|
| 1,578,264 | A | * | 3/1926 | Church | 76/87 |
| 3,376,671 | A | * | 4/1968 | Wolter | 451/67 |
| 4,567,693 | A | * | 2/1986 | Magnuson | 451/65 |
| 4,617,765 | A | * | 10/1986 | Weiler | 451/558 |
| 4,627,194 | A | | 12/1986 | Friel | |
| 4,716,689 | A | | 1/1988 | Friel | |
| 4,807,399 | A | | 2/1989 | Friel | |
| 4,823,498 | A | * | 4/1989 | Banta | 43/25 |
| D303,209 | S | | 9/1989 | Friel | |
| D310,620 | S | | 9/1990 | Friel | |
| 5,001,945 | A | | 3/1991 | Lindeen | |
| 5,005,319 | A | | 4/1991 | Friel | |
| D328,410 | S | | 8/1992 | Friel | |
| 5,148,634 | A | | 9/1992 | Bigliano | |
| 5,245,791 | A | | 9/1993 | Bigliano | |
| 5,251,351 | A | * | 10/1993 | Klotz | 7/100 |
| 5,390,445 | A | | 2/1995 | Giovanazzi | |
| 5,611,726 | A | | 3/1997 | Friel | |
| D404,278 | S | * | 1/1999 | Gore | D8/93 |
| 5,879,229 | A | * | 3/1999 | Anderson | 451/523 |
| D409,891 | S | | 5/1999 | Friel | |
| 5,941,763 | A | * | 8/1999 | Kaye | 451/278 |
| 6,012,971 | A | | 1/2000 | Friel | |
| 6,030,283 | A | * | 2/2000 | Anderson | 451/558 |

(Continued)

*Primary Examiner* — Eileen P. Morgan
(74) *Attorney, Agent, or Firm* — Novak Druce Connolly Bove + Quigg LLP

(57) ABSTRACT

A combination sharpener assembly which is particularly useful for fishermen, includes an electrically powered knife sharpener. A manually operated scissors sharpener is mounted in the recess of the housing for the knife sharpener. A hook sharpener is detachably mounted in a compartment in the housing of the knife sharpener. The motor for the knife sharpener is mounted in a sealed inner housing and can be selectively operated under either direct current or alternating current.

10 Claims, 19 Drawing Sheets

(56) References Cited

U.S. PATENT DOCUMENTS

| | | | | |
|---|---|---|---|---|
| 6,071,181 | A | 6/2000 | Wightman | |
| 6,101,898 | A | 8/2000 | Gore | |
| 6,113,476 | A | 9/2000 | Friel | |
| 6,267,652 | B1 | 7/2001 | Friel | |
| 6,846,231 | B2 * | 1/2005 | Oles et al. | 451/415 |
| 6,863,600 | B2 | 3/2005 | Friel | |
| 6,875,093 | B2 | 4/2005 | Friel | |
| 6,881,137 | B2 | 4/2005 | Friel | |
| 6,997,795 | B2 | 2/2006 | Friel | |
| 7,108,595 | B2 * | 9/2006 | Reisinger | 451/461 |
| 7,118,466 | B2 * | 10/2006 | Laney | 451/293 |
| 7,121,923 | B1 | 10/2006 | Sweet | |
| 7,125,327 | B2 * | 10/2006 | Wu | 451/490 |
| 7,182,679 | B2 * | 2/2007 | Scott | 451/367 |
| D542,616 | S | 5/2007 | Elek | |
| D543,430 | S | 5/2007 | Barr | |
| 7,235,004 | B2 | 6/2007 | Friel | |
| 7,287,445 | B2 | 10/2007 | Friel | |
| D567,611 | S | 4/2008 | Elek | |
| 7,413,504 | B2 * | 8/2008 | Lytinas | 451/67 |
| 7,452,262 | B2 | 11/2008 | Friel | |
| 7,488,241 | B2 | 2/2009 | Elek et al. | |
| 7,494,403 | B2 | 2/2009 | Friel | |
| 7,517,275 | B2 | 4/2009 | Friel | |
| 7,686,676 | B2 | 3/2010 | Friel | |
| D620,332 | S | 7/2010 | Elek | |
| 8,043,143 | B2 | 10/2011 | Elek | |
| D651,887 | S | 1/2012 | Elek | |
| D652,284 | S | 1/2012 | Elek | |
| D665,647 | S | 8/2012 | Friel | |
| 8,267,750 | B2 | 9/2012 | Friel | |
| 8,485,867 | B2 * | 7/2013 | Wu | 451/349 |
| 8,616,938 | B1 * | 12/2013 | Mills | 451/349 |
| 2007/0266828 | A1 * | 11/2007 | Byers | 76/82 |
| 2008/0274675 | A1 * | 11/2008 | Chen | 451/65 |
| 2009/0233530 | A1 | 9/2009 | Friel | |
| 2009/0275272 | A1 * | 11/2009 | Bonapace | 451/321 |
| 2011/0217912 | A1 * | 9/2011 | Dai | 451/555 |
| 2012/0183365 | A1 * | 7/2012 | Rozycki et al. | 408/22 |

* cited by examiner

MANUALLY OPERATED SHARPENER

CROSS REFERENCE TO RELATED APPLICATION

This application is a division of application Ser. No. 13/927,253 filed Jun. 26, 2013, all of the details of which are incorporated herein by reference thereto.

BACKGROUND OF THE INVENTION

Various types of specialized sharpeners exist to address the needs dictated by different types of cutting instruments or other tools that should be maintained in a sharp condition. There are times when it would be desirable to have multiple sharpeners available. One such example is use by fishermen where a knife sharpener is desired for sharpening a knife that might be used in filleting a fish. Another type of sharpener that might be desired is a scissors sharpener for cutting lines such as line snipers. A further sharpener might be desired to maintain a hook in a sharp condition.

It would be advantageous if the various types of sharpeners, such as desired by a fisherman, could be included as a common sharpener assembly so that the individual sharpeners are conveniently and readily available. Such concept of providing multiple sharpeners could also be used in situations where it would be useful to have multiple sharpeners assembled as a combination where the sharpeners are not the specific combination of knife sharpeners used with scissors sharpeners and hook sharpeners.

A further consideration, as regards fishermen, is that where one of the sharpeners, such as the knife sharpener, is electrically powered, having an AC power source might not be readily available. Thus, the fisherman would have to do the actual sharpening of a knife at an inconvenient distant location.

SUMMARY OF INVENTION

An object of this invention is to provide a combination sharpener assembly that includes multiple sharpeners so that different types of cutting instruments could be readily sharpened.

A further object of this invention is to provide such a combination sharpener assembly which has particular utility for, but not limited to, fishermen.

In accordance with this invention, a combination sharpener assembly comprises an electrically powered sharpening unit having at least one motor driven sharpening element for cutting instruments such as a knife. A manual sharpening module is detachably mounted to the electrically powered sharpening unit and can be detached so that a different type of cutting instrument, such as a scissors, could be sharpened.

In a preferred practice of this invention the electrically powered sharpening unit includes a motor in a motor chamber within the outer sharpener housing. The motor chamber is substantially sealed to protect the motor from direct contact with water, such as from a water hose or from splashing. Preferably, the motor is selectively actuated by either a DC power cord or an AC power cord. The motor can be started using pulsing technology so that the motor can be initially turned on using a current higher than the normal maximum current used during the operation of the motor.

The manual sharpening module is preferably a scissors sharpener having its housing detachably mounted in a recess in the housing of the electrically powered sharpening unit. Preferably, the manual sharpening module includes a rotatable carousel having a coarse abrasive sharpening pad and oppositely mounted fine abrasive pad with a thumb wheel controlling which pad would be directed toward the guide surface on which the scissors blade would be placed. The abrasive pads are preferably mounted on a carousel barrel threadably engaged with a threaded vertical rod to change the area of the pad being used in sharpening.

The combination sharpener assembly also preferably includes a power operated component mounted within a compartment of the electrically powered sharpening unit housing. The sharpening component preferably in a battery powered hook sharpener which includes a detachable bit for sharpening items such as fish hooks. The closure for the compartment may include further sharpening bits detachably mounted to the closure.

THE DRAWINGS

DETAILED DESCRIPTION

Figure 1:
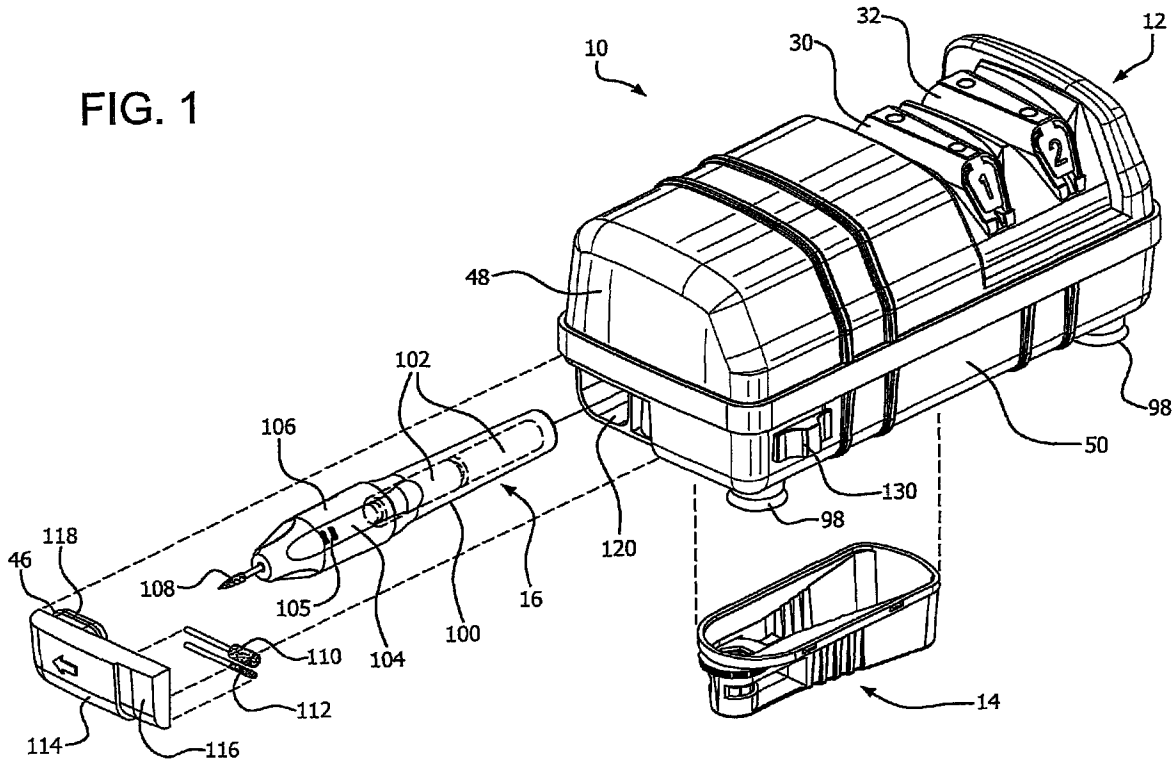
FIG. 1 is a perspective view looking downward of a combination sharpener assembly showing the electrically powered sharpening unit (knife sharpener) and the manual sharpening module (scissors sharpener) and the battery powered sharpening component (hook sharpener)
Figure 2:
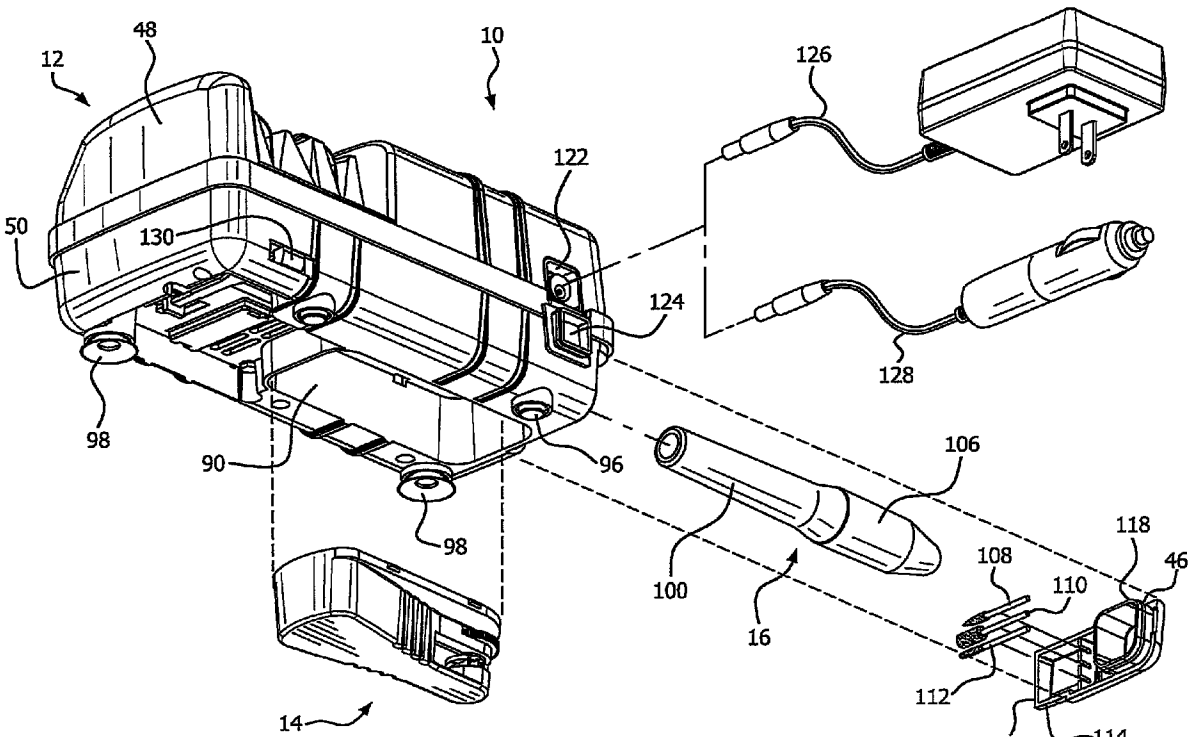
FIG. 2 is a perspective view looking upward of the assembly of FIG. 1.
Figure 3:
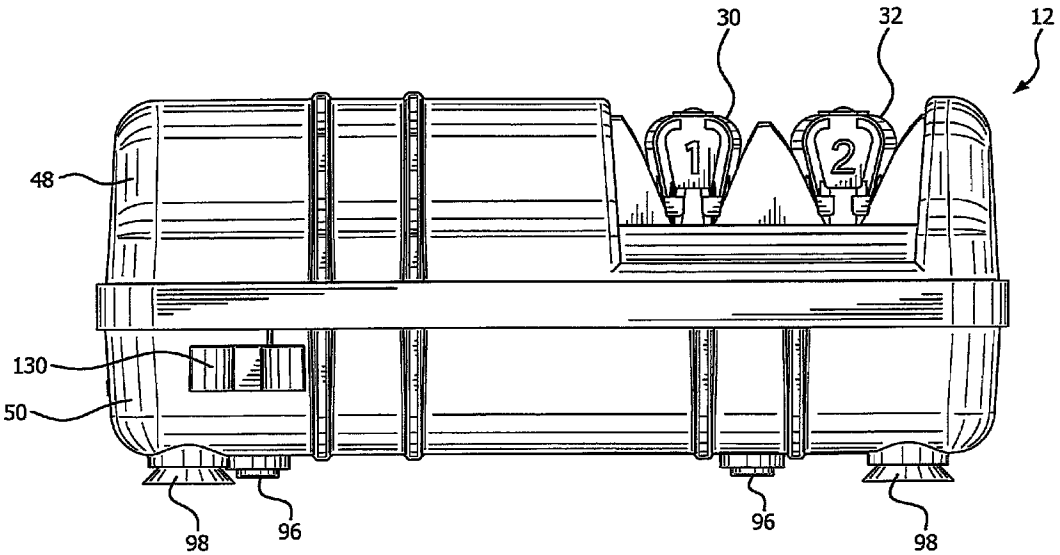
FIG. 3 is a front elevational view of the electrically powered knife sharpening unit of the assembly of FIGS. 1-2.
Figure 4:
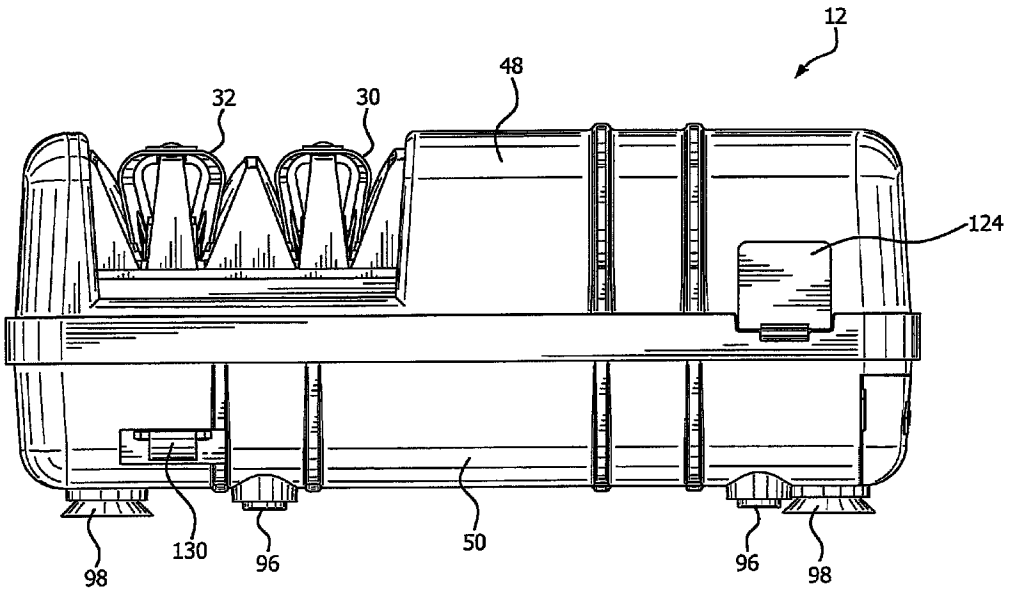
FIG. 4 is a rear elevational view of the electrically powered knife sharpening unit of FIGS. 1-3.
Figure 5:
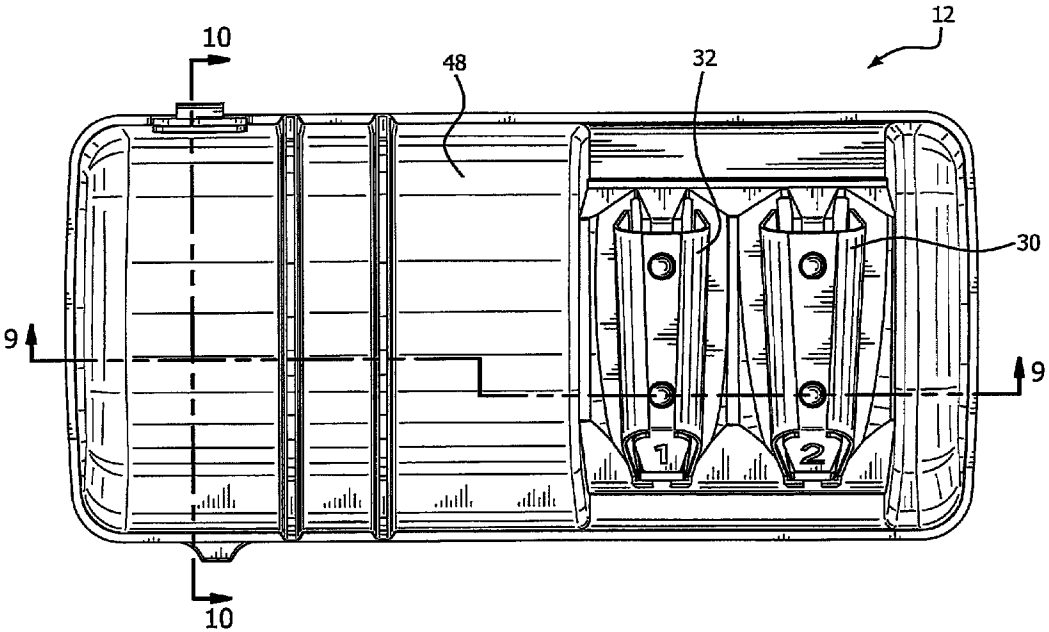
FIG. 5 is a top plan view of the electrically powered knife sharpening unit of FIGS. 1-4.
Figure 6:
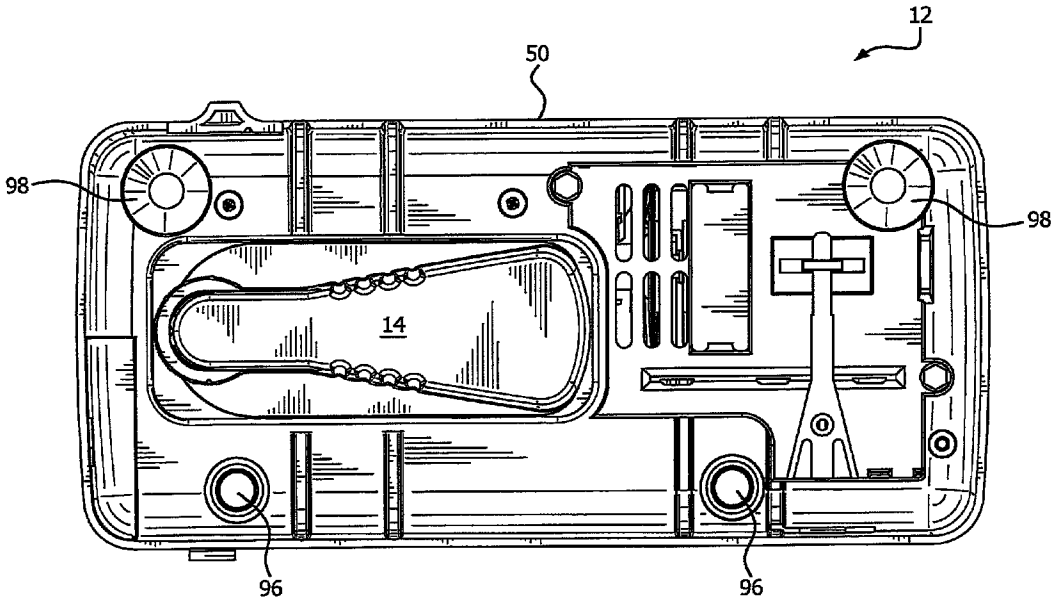
FIG. 6 is a bottom plan view of the assembly of FIGS. 1-2 showing both the electrically powered knife sharpening unit and the manual scissors sharpening module.
Figure 7:
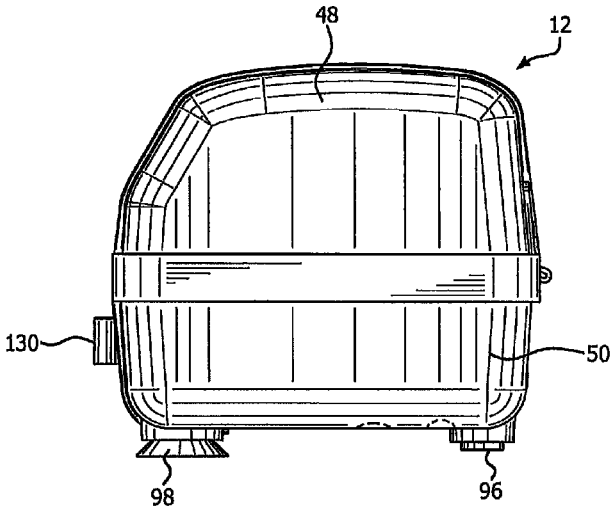
FIGS. 7 and 8 are end elevational views of the housing of the electrically powered knife sharpening unit of FIGS. 1-2.

FIG. 1 shows the combination sharpener assembly 10 in accordance with this invention when viewed from the top. FIG. 2 shows the assembly 10 when viewed from the bottom. As shown therein assembly 10 includes an electrically powered sharpening unit 12 which has at least one sharpening stage with at least one sharpening element in the sharpening stage. Preferably, sharpening unit 12 is a multi-stage knife sharpener.

Assembly 10 also includes a manual sharpening module 14 which is detachably mounted to the housing of electrically powered sharpening unit 12. Preferably sharpening module 14 is a scissors sharpener.

A further sharpening module in assembly 10 is a power (battery) operated sharpening component 16 which could be used by fishermen for sharpening fishing hooks.

Figure 9:
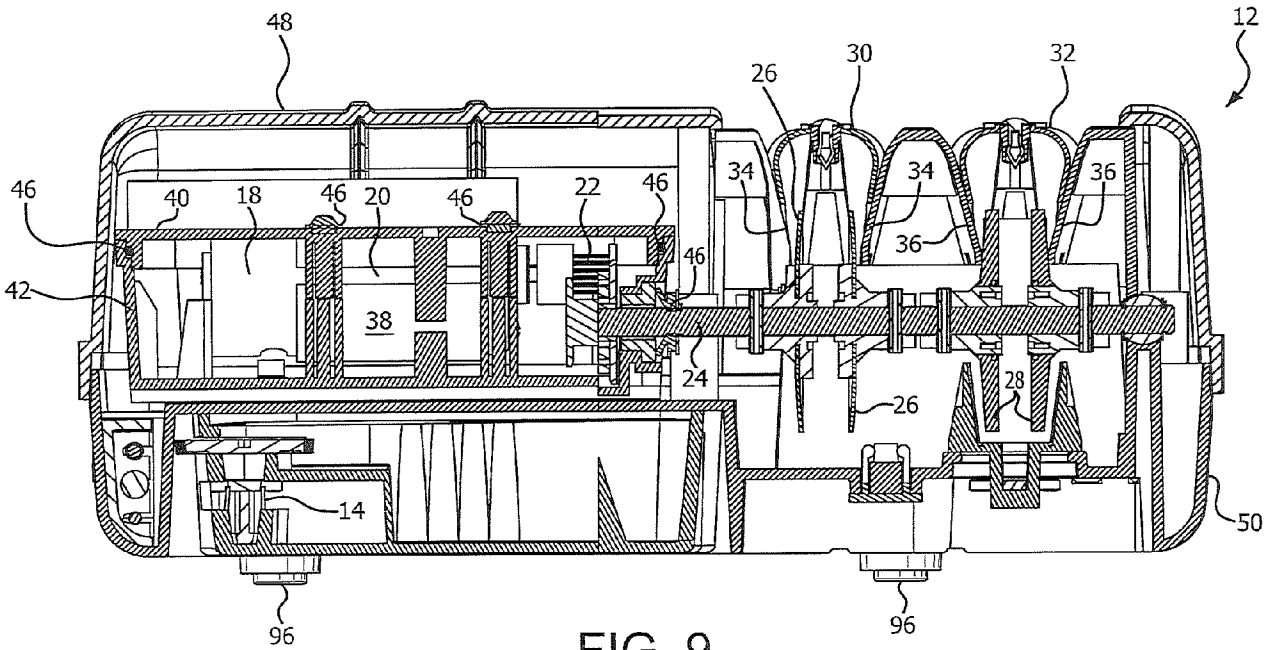
FIG. 9 is a cross-sectional view taken through FIG. 5 along the line 9-9.
Figure 10:
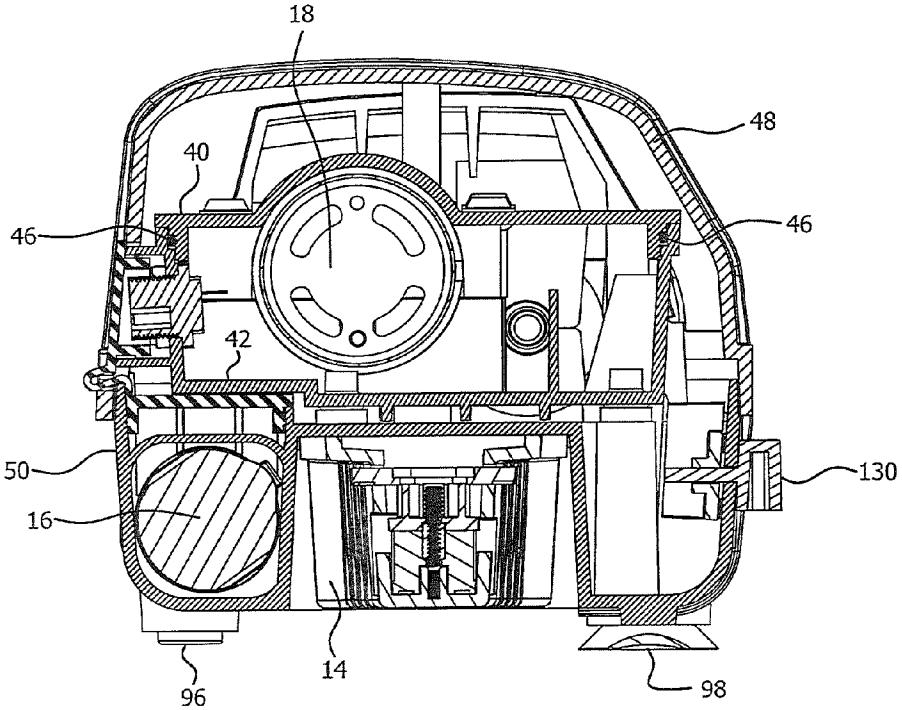
FIG. 10 is a cross-sectional view taken through FIG. 5 along the line 10-10.

In the preferred practice of this invention electrically powered sharpening unit 12 is a knife sharpener which may be operated in a manner similar to the sharpeners shown in U.S. Pat. Nos. 5,611,726, 6,012,971 and 6,875,093 all of the details of which are incorporated herein by reference thereto. FIG. 9 best illustrates the main components of the knife sharpener 12. As shown therein a motor 18 rotates its shaft 20 to drive gear train 22. Gear train 22 drives sharpener shaft 24 on which are mounted sets of abrasive coated disks 26,28 in each of the sharpening stages in a manner known in the art. A hold down spring 30,32 is provided at each stage so that a knife can be inserted against a guide surface 34,36 in each stage and be directed against the rotating abrasive disk 26,28. Thus, when a cutting instrument, such as a knife, is placed against the appropriate guide surface 34,36 and urged into contact with the rotating sharpening element or abrasive disk, the knife would be sharpened in a known manner.

The housing of knife sharpener 12 includes special features designed to accommodate other types of sharpeners and to effectuate other features of this invention. For example, motor 18 is located in an inner housing or motor chamber 38, in the motor section of the knife sharpener outer housing. One of the features in the preferred practice of this invention is to prevent or limit the motor 18 from contact with water. This is particularly important when knife sharpener 12 is used at a fishing site where there could be splashing of water or where the fisherman might wish to hose down the sharpener. In order to provide this generally sealed chamber, the chamber is formed by an imperforate lid 40 over imperforate chamber housing 42. Sealing elements, such as gaskets 46 are provided where the lid 40 and chamber housing 42 contact each other. A gasket seal also seals where sharpening shaft 24 enters the motor chamber 38. Gaskets would also seal the attachment screws for the motor cover. In addition, the later described power port cover 124 (FIG. 2) when closed would seal power port 122. These seals prevent water from entering motor chamber 38 and contacting motor 18.

The outer housing for knife sharpener 12 is generally formed from two shells, upper shell 48 and lower shell 50. If desired, sealing material, such as gaskets, could also be provided where these shells are joined together.

The manual sharpening module 14 which operates without use of any motor drive is preferably a scissors sharpener which is illustrated primarily in FIGS. 13-22 and is also shown in other figures.

The manual sharpening module or scissors sharpener 14 includes a base 52 for resting on a support surface, such as a table. A generally triangularly shaped shell 54 extends upwardly from base 52. The base 52 and shell 54 form a hollow housing having an open bottom. The sharpening components are located at the narrow extension 55 of shell 54. Shell 54 is provided with a series of longitudinal grooves 56 so that the shell 54 can easily be gripped and function as a handle, particularly for squeezing shell 54 as later described. The extension 55 of shell 54 above base 52 has an open area with a flat surface 58 which functions as a guide surface. A carousel 60 is mounted in extension 55 adjacent the guide surface 58. Carousel 60 includes a non-circular base 62 which fits in a complementary opening 64 of thumb wheel 66. See FIG. 18. Carousel 60 includes a barrel 68 which extends upwardly from base 62. Barrel 68 has a pair of flat surfaces 75 where abrasive pads 70,72 are located above flange 69. A threaded rod 74 extends through an axial opening 76 in barrel 68 and threadably engages an internally threaded axial opening 79 of insert 78 pressed into opening 76 of barrel 68. See FIGS. 17 and 18. The upper end of rod 74 fits into sleeve 77 of the shell extension 55.

Thumb wheel 66 includes indicia such as the word "coarse" and "fine" to correspond to pads 70,72. When thumb wheel 66 is rotated a corresponding abrasive pad 70 or 72 would be disposed at guide surface 58 and the indicia on thumb wheel 66 would indicate whether it is a coarse abrasive pad or a fine abrasive pad that is being used for the sharpening operation.

Figure 18:
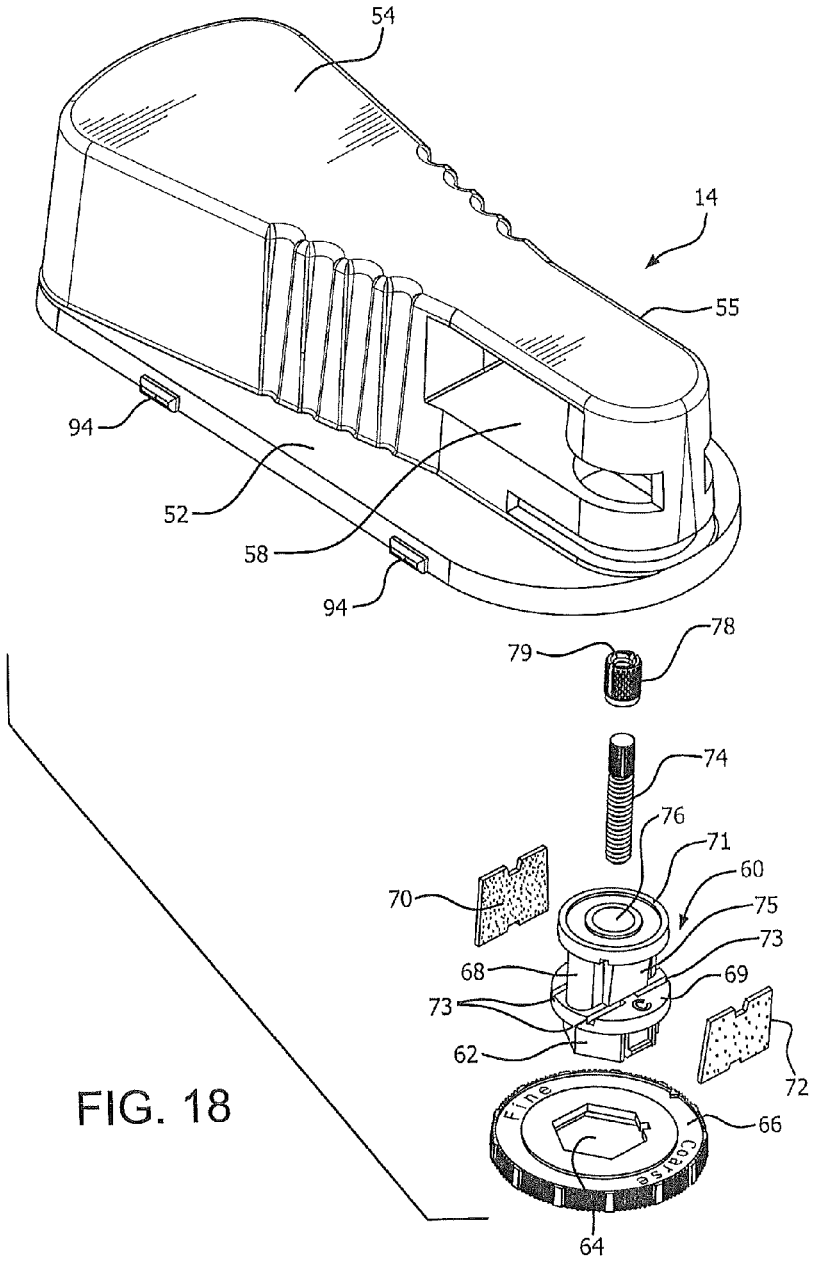
FIG. 18 is an assembly view of the manual scissors sharpening module of FIGS. 13-17.
Figure 18A:
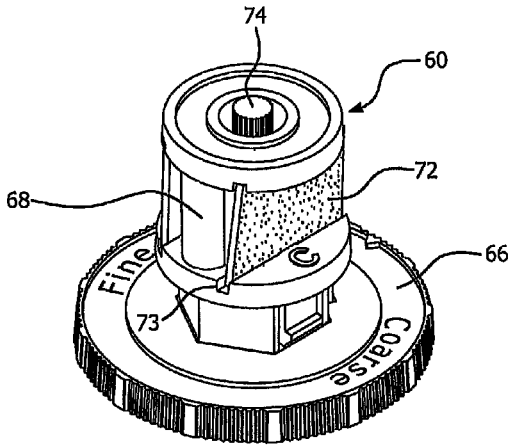
FIG. 18A is a perspective view of the carousel used in the manual scissors sharpening module of FIGS. 13-18.
Figure 18B:
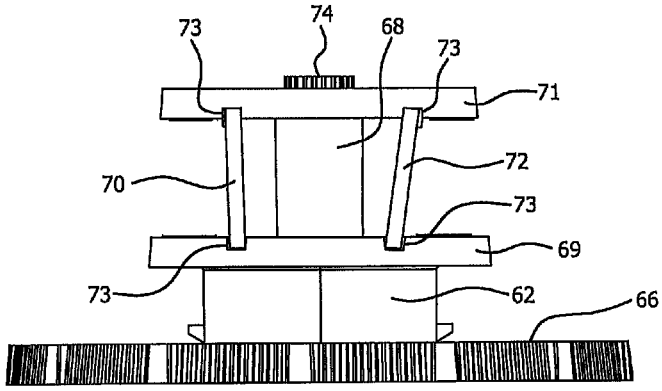
FIG. 18B is a side elevational view of the carousel shown in FIG. 18A.

As best shown in FIGS. 18A and 18B barrel 68 includes a lower outwardly extending circular flange 69 and an upper outwardly extending circular flange 71. Each flange 69,71 is provided with a set of parallel slots 73 in the upper surface of flange 69 and lower surface of flange 71 located adjacent the flat sides 75 of barrel 68. See also FIG. 18. Each respective abrasive pad 70,72 is inserted into a set of the upper and lower slots adjacent the respective flat side 75 of barrel 68 to mount each pad in a planar condition. By having the upper slots and lower slots offset or displaced from each other (FIG. 18B), the angular orientation of pads 70,72 differs from each other. One set of slots can be vertically aligned to maintain its pad perpendicular.

The carousel 60 thus allows different abrasives and different angles to be integrated into the unit. Stages can be changed by the user simply by rotating the barrel 180°. The abrasive cartridge can contain at least one coarse diamond abrasive pad set at an angle between 70° and 85°. This provides rough resurfacing for well worn scissors blades. The user can then rotate the carousel 60 to the fine stage which has at least one finer diamond abrasive pad set at an angle between 80° and 90° to put a fine edge on the scissors blades. The carousel 60 can be rotated by hand by using the thumb wheel 66 that protrudes from the front of the sharpener 14. This is an improvement over existing designs which may have only one stage of sharpening or are more difficult to change between sharpening stages.

Figure 19:
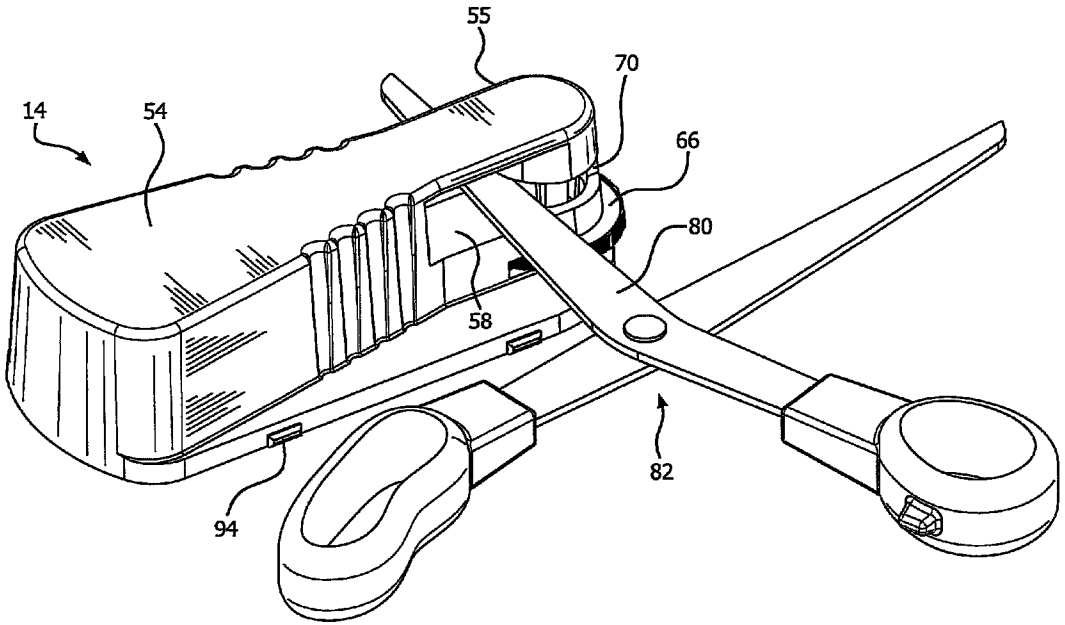
FIG. 19 is a perspective view showing use of the manual sharpening module of FIGS. 13-18 for sharpening scissors.

In use, as shown in FIG. 19, the blade 80 of a scissors 82 would be placed on guide surface 58 and disposed against an abrasive pad. Because of the configuration of barrel 68 having flat sides and by mounting the pads in slots 73, the abrasive pads 70,72 are oriented in a flat planar condition rather than being wrapped into a curved condition. The blade 80 or each side of the scissors 82 is sharpened independently simply by placing the inside of the blade against the guide surface 58 and moving the blade in a back and forth motion against the abrasives which are preferably diamond particles. Precision angle control is achieved because the scissors blade is easily held against the flat blade guide 58, and the angle of the abrasive is maintained by the sharpener. This is an improvement over existing manual sharpeners where the user must hold and close the scissors properly over a ceramic abrasive stick such as shown in U.S. Pat. No. 6,101,898 or a metal grinding element such as shown in U.S. Pat. No. 5,001,945. Closing the two scissors blades consistently on the abrasive stick can be difficult for some users and lead to poor sharpening results. The motion of the sharpener 14 is also more intuitive, since the sharpener can be rested on a work surface, such as a table, with the base 52 of the sharpener directly on the support surface and the blade is guided in a very easy and obvious motion.

The design of the carousel 60 allows the abrasive pads 70,72 to stay constantly parallel to the blade edge even as the user may vary the angle of the blade in the sharpener slightly. The design enables the carousel 60 to rotate freely so pressure from the scissors blade keeps it aligned. Since the abrasive pads 70 or 72 can constantly follow the blade 80 it can better provide a consistent, even sharp edge. It also provides for more even wear on the abrasive pad 70,72. This is an improvement over existing designs where the user must be careful to hold the scissors in a manner where the blade edge is constantly in contact with an abrasive pad or models that use a rod-type abrasive whose point-contact can lead to an uneven edge.

Figure 17:
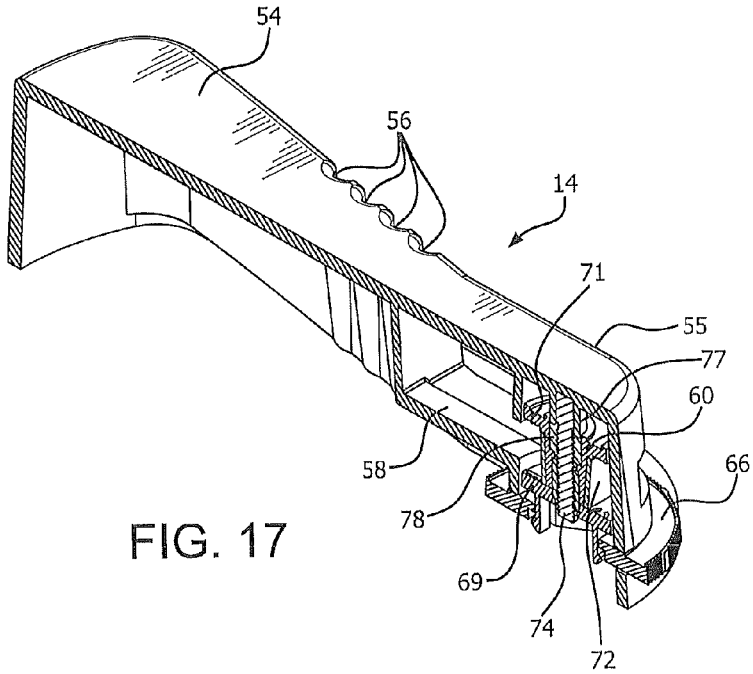
FIG. 17 is a cross-sectional view taken through FIG. 16 along the line 17-17.

A further feature of sharpener 14 is to permit the abrasive pads 70,72 to move vertically during normal use so as to vary the abrasive surface being used. All abrasive surfaces used for sharpening wear over time. Wear is accelerated in some prior designs since the same small area of the abrasive pad or rod is used with every sharpening. With sharpener 14, however, the area of the abrasive pad that is utilized changes as the barrel 68 is turned to change stages. As shown in FIG. 17 threaded rod 74 is engaged with lower flange 69 for movement of the barrel 68 vertically up or down in accordance with the movement of thumb wheel 66. Thus, with each turn of the barrel 68 the pads 70,72 move up or down a small amount due to the barrel 68 pivoting on the threaded rod 74 during use.

Manual scissors sharpener 14 is uniquely compact in design and is able to effectively sharpen scissors by maintaining a precise sharpening angle against an abrasive pad. Sharpener 14 is capable of multi-stage sharpening due to its carousel design that is able to utilize different sizes and levels of abrasives at different sharpening angles.

In the illustrated embodiment of this invention, carousel 60 has two flat sides 75 on its barrel 68 to accommodate a respective abrasive pad 70,72. Thus, the user may selectively sharpen a scissors blade using either a coarse or a fine abrasive diamond pad. The invention may also be practiced where the barrel 68 has more than two flat sides, such as four sides, each with a corresponding abrasive pad which may have its abrasive characteristics between fine and coarse and thus accommodate different width sizes set at different angles for a variety of different scissors. Where additional abrasive pads are used, additional sets of slots would also be provided in flanges 69, 71 of carousel 60 to accommodate the additional abrasive pads.

Figure 20:
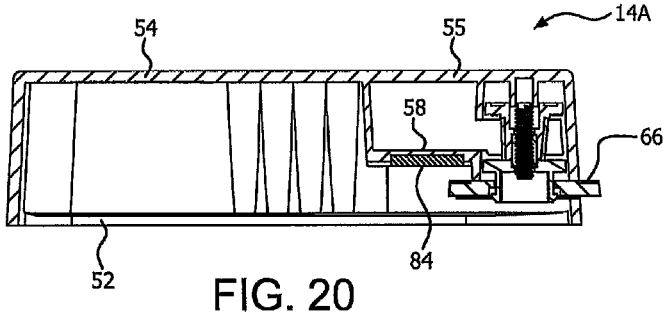
FIGS. 20-22 are cross-sectional views of alternative manual scissors sharpening modules in accordance with this invention.
Figure 21:
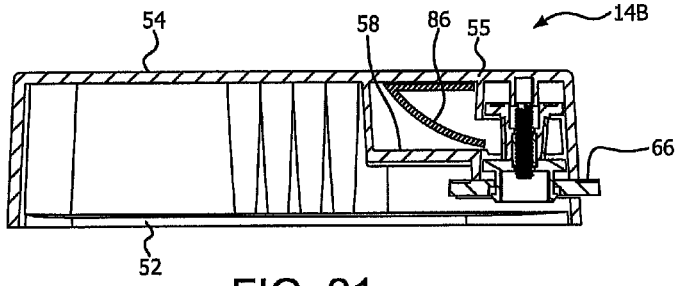
Figure 22:
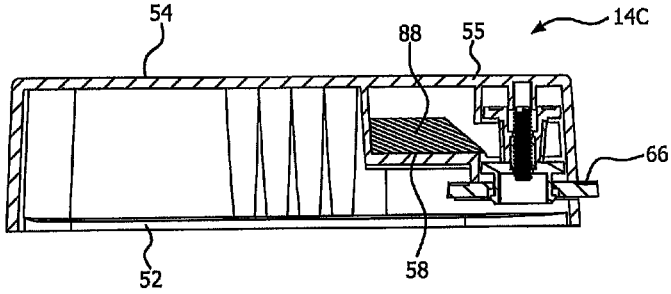

FIGS. 20-22 show other variations of the scissors sharpener. As shown in FIG. 20 the scissors sharpener 14A has a magnet 84 located under the guide surface 58 for attracting a scissors blade in order to better maintain a constant angle for the scissors blade as the blades are being sharpened. Alternatively, or in addition, the abrasive pads 70,72 may also be magnetized to ensure better contact with the sharpening edge.

FIG. 21 shows a further alternative sharpener 14B wherein a hold-down spring is mounted to the inner surface of the extension 55 of shell 54. The spring has a spring arm 86 which extends toward but slightly spaced from the guide surface 58. The hold-down spring may be made of any suitable resilient material, such as a flexible plastic member to hold the scissors blade in place against the guide surface.

FIG. 22 illustrates yet another variation of the invention wherein sharpener 14C has a wedge 88 mounted on surface 58 to provide a substitute guide surface with a modified angle against which the scissors blade would be disposed to guide the scissors blade into contact with the abrasive pad. The sharpener 14C thus accommodates knife-edge scissors wherein the wedge will hold the scissors at a modified angle which is unique to knife-edge scissors. Preferably the wedge 88 is a removable insert which can be replaced by other inserts having different geometry. A further variation would be to structure the wedge as an adjustable insert so that variations in guide angle can be achieved without having to remove one insert and replace it with another. Any suitable means may be used to provide for such adjustability, such as by mounting the insert on a threaded member which extends through the guide surface 58 so as to raise or lower the insert and alter the orientation of the insert.

Figure 11:
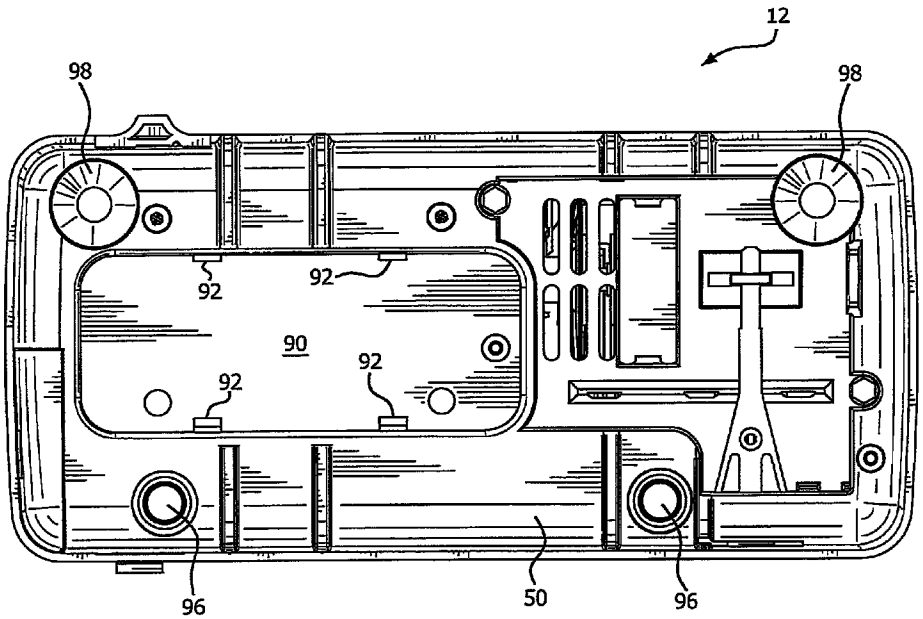
FIG. 11 is a plan view of the housing of the electrically powered knife sharpening unit of the assembly of FIGS. 1-2 without the manual scissors sharpening module.
Figure 12:
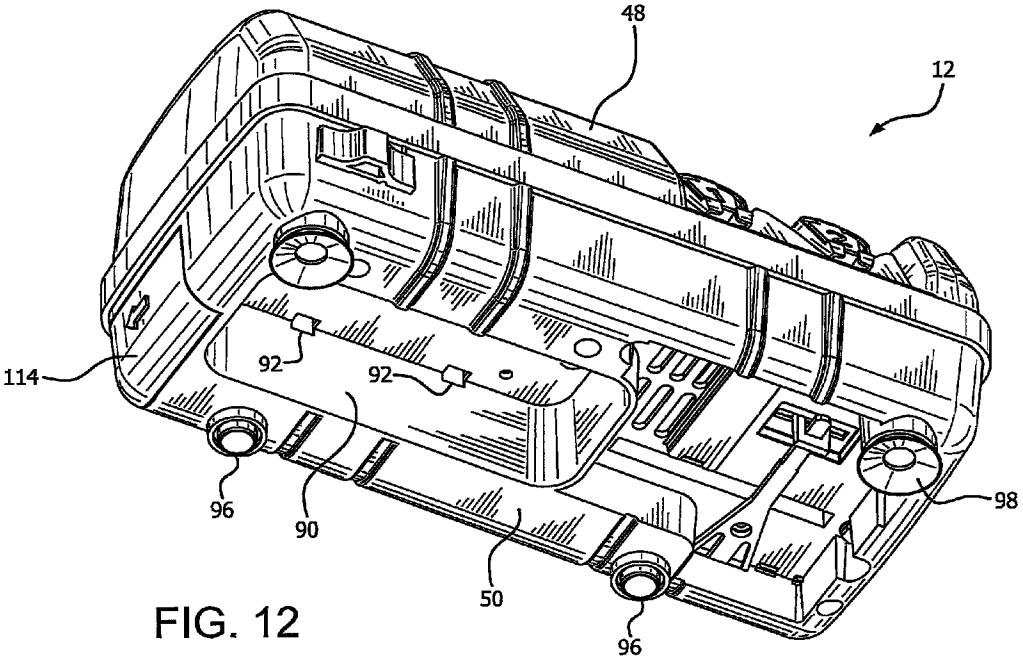
FIG. 12 is a perspective view looking upwardly of the housing of the electrically powered knife sharpening unit of FIGS. 1-2 without the manual scissors sharpening module.
Figure 13:
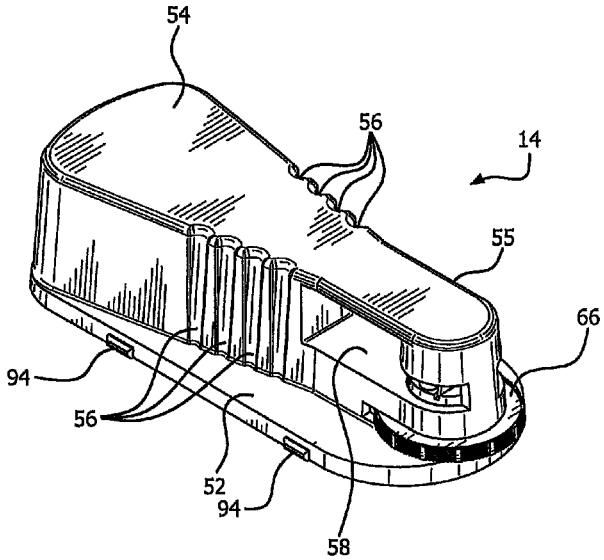
FIG. 13 is a perspective view of the manual scissors sharpening module in the assembly of FIGS. 1-2.
Figure 14:
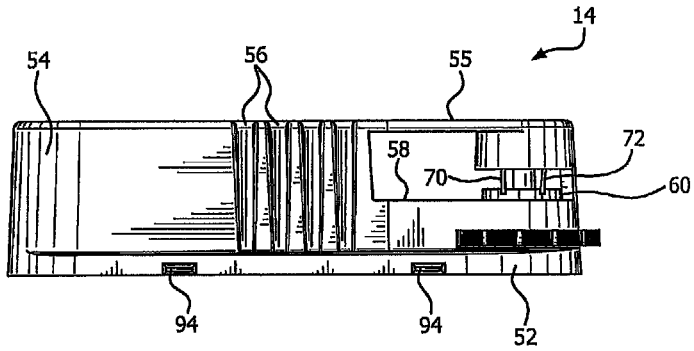
FIG. 14 is a front elevational view of the manual scissors sharpening module of FIG. 13.
Figure 15:
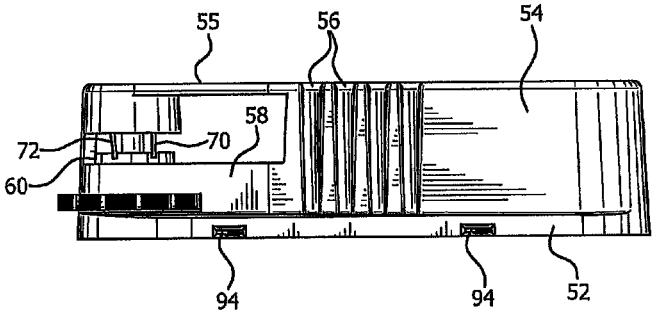
FIG. 15 is a rear elevational view of the manual scissors sharpening module of FIG. 13.
Figure 16:
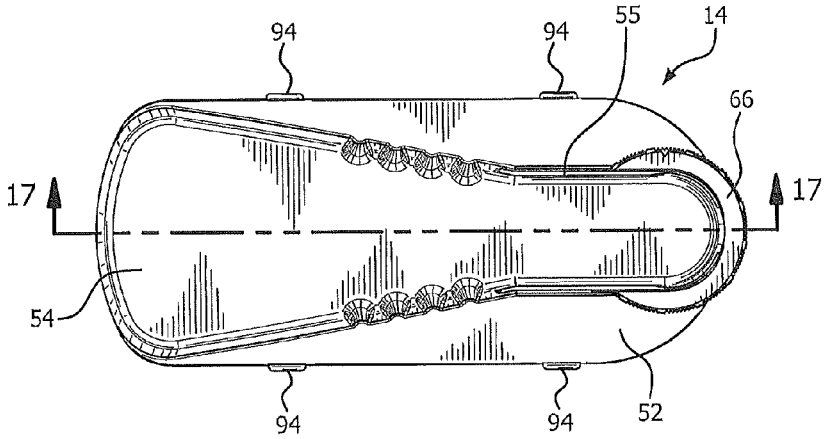
FIG. 16 is a top plan view of the manual scissors sharpening module of FIGS. 13-15.

Advantageously scissors sharpener 14 is detachably mounted to the housing of knife sharpener 12. Reference is made to FIGS. 2 and 11-13 with regard to the manner of detachably mounting scissors sharpener 14 to knife sharpener 12 so that both sharpeners can be stored together and readily available for use of each sharpener. As shown in FIGS. 2 and 11-12 the lower housing shell 50 for knife sharpener 12 includes a recess 90 in its bottom side. A set of slots or openings 92 is provided at spaced locations in the recess 90. See FIGS. 11-12. The base 52 of scissors sharpener 14 includes a corresponding set of tabs or locking projections 94 positioned for insertion into the respective slots 92. The hollow shell 54 and base 52 of scissors sharpener 14 is stiff, but sufficiently resilient that its opposing walls can be squeezed together which would move the projections 94 inwardly a sufficient distance so that upon the cessation of the squeezing action the projections 94 move back outwardly for engagement in the slots 92. This firmly mounts the scissors sharpener 14 in the housing of knife sharpener 12. When it is desired to remove the scissors sharpener the shell 54 is again squeezed to remove the projections 94 from the slots 92 so that the scissors sharpener 14 can be readily removed. The walls of recess 90 thus function as a storage member for sharpener 14.

As shown in the various figures the lower shell 50 of the outer housing for the knife sharpener 12 has a plurality of feet which extend below the periphery of the housing to elevate the housing above a support surface. As illustrated stored scissors sharpener is also elevated above the support surface. One set of feet 96,96 may be of generally cylindrical shape made of a rubber or other material that will not damage the support surface. The other set of feet 98,98 may include suction cups to hold the knife sharpener housing in place during use. If desired, all of the feet may include suction cups or the suction cups may be omitted. As shown in FIGS. 3-4, 7-8 and 10 the suction cup feet 98 extend downwardly from the housing bottom a slightly greater distance than the rubber feet 96. When, however, the suction cups are pressed against the support surface both sets of feet will extend downwardly the same distance.

The combination sharpener assembly 10 may also include a third sharpener, namely the hook sharpener 16 which is best shown in FIGS. 1-2. As shown therein, hook sharpener 16 includes a generally cylindrical hollow casing 100 for holding a suitable number of batteries 102 to energize the drive mechanism 104 in the detachably mounted operating end 106 of the sharpener 16. Drive mechanism 104 is actuated by depressing switch 105. A sharpening tool bit 108 is rotatably driven by the drive mechanism 104 generally in the same manner as in known Dremel tools.

One of the features of hook sharpener 16 is the ability to use different types of bits for sharpening the hooks. FIG. 1, for example, shows the mounted sharpening bit 108 having diamond abrasive particles and being of a generally truncated cone shape. FIG. 2 shows bit 108 detached. FIGS. 1-2 show a further bit 110 which is cylindrical in shape and has a stone abrasive surface. A third illustrated bit is bit 112 which is of generally small diameter cylindrical shape tapering slightly at its end and made of diamond abrasive particles. Each of the bits 108, 110 and 112 functions to obtain a different sharpening action that can be used for different types of hooks. Other types of bits may also be used. Conveniently, the bits are mounted to an offset extension 116 of cover 114 for detachably holding the bits. Cover 114 also includes a closure portion 118.

Figure 8:
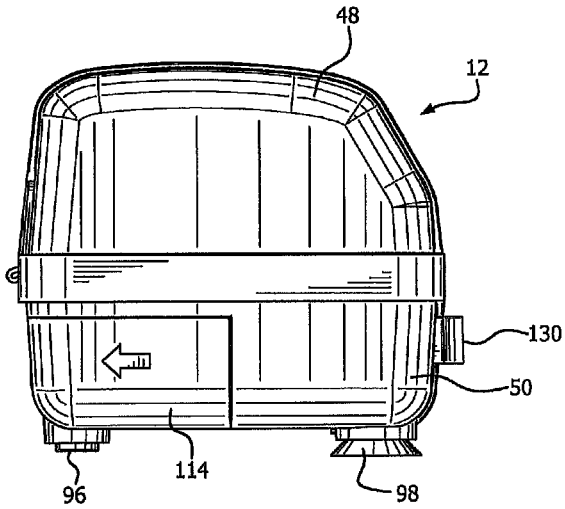

Conveniently, as shown in FIG. 1, hook sharpener 16 is removably slidably inserted in a compartment 120 in the lower shell 50 of the housing of knife sharpener 12. The housing of knife sharpener 12 has a recess in its side so that cover 114 may slide in the recess until the closure 118 enters and fits snuggly in the open end of compartment 120. Cover 114 conforms the shape of the lower shell 50 of the housing. FIGS. 8 and 12 show the cover 114 mounted in place with a directional arrow indicating the direction of movement to detach the cover 114 and permit hook sharpener 16 to be removed from compartment 120.

A further feature of this invention is to provide the knife sharpener 12 with the ability to be operated where AC power is not available. FIG. 2 illustrates the power port 122 which would be electrically connected to motor 18. Power port 122 can optionally be powered by AC power cable 126 that could be plugged into a conventional outlet. Alternatively, power port 122 could be powered by a DC power cable 128 that could be plugged into, for example, a cigarette lighter of a vehicle. Thus, if a conventional outlet is not readily available the power cord 128 would be connected to power port 122. Alternatively, where a conventional outlet is available, the AC power cord 126 could be connected to power port 122.

Figure 23:
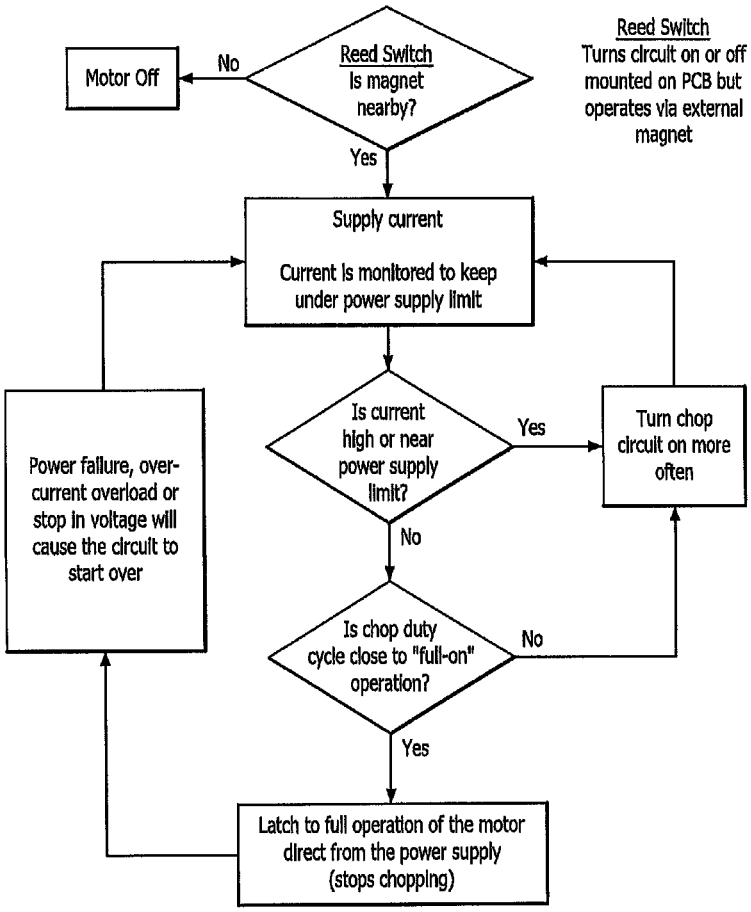
FIG. 23 is a block diagram showing the printed circuit board used for starting the motor of the electrically powered knife sharpening unit in the assembly of FIGS. 1-2.

One of the features of this invention is the use of unique circuitry for starting motor 18 when using DC power. A 12 VDC switching power supply would be used to take advantage of its economy and availability. However, the power supply's maximum current is limited, such as to 2.5 amps. Drawing more current trips a safety overload that turns power off. The motor 18 for the knife sharpener 12 would run at a current below the maximum, such as at an average of 1.5 amps. However, in order to start the motor 18 at full voltage a greater number of amps, such as 7 amps, would be required which exceeds the maximum current for the running of motor 18. In order to start motor 18 at this higher current, such as 7 amps, a printed circuit board (PCB) utilizes pulsing technology (pulse width modulation). A circuit is used to create a pulse waveform at high frequency that can control the voltage and current supplied to the motor 18. This is a technique commonly used in industrial applications. FIG. 23 illustrates a block diagram for the PCB starting motor 18 after DC power cord 128 is connected with power port 122. Switch 130 is of FIGS. 1, 2 and 23 turned on. The various control and monitor functions (including the safety latch for turning off the power) illustrated in FIG. 23 then assure that the motor 18 can be properly started and then run at a current below its maximum.

The use of pulsing technology in accordance with this invention has advantages over other existing technology. For example, capacitors can be used to store voltage and supply a boost during motor starting. It is difficult, however, to find a capacitor value or size that would work effectively for the motor 18 of the knife sharpener 12. A resistor might also be used in a series to start a motor. The resistor, however, has a main disadvantage that it continues to limit the motor's power and consumes energy, even after the motor is started. NTC thermistors have a resistance that changes with heat and time. These electronic components start with an initial resistance value and decrease in resistance during use. Their main disadvantage is that they require several minutes of recovery time to re-start the motor. With regard to a multi-position start switch, a momentary switch can be used to start the motor with a resistor then switch the resistor out for steady-state operation. This has a main disadvantage, however, that it requires the user to know the proper threshold of motor speed before to switch to normal running speed. These disadvantages are overcome by use of the pulsing technology in accordance with this invention.

While the present invention is particularly adapted for use by fishermen or for other marine purposes, the concepts of this invention may also be used for other types of sharpeners. Preferably, the invention is practiced where the combination sharpener assembly includes an electrically powered sharpening unit for sharpening a cutting instrument and further includes a manual sharpening module for sharpening a cutting instrument and may include a power operated or manual cutting element for sharpening yet other cutting instruments.

What is claimed is:

1. A manually operated sharpener comprising a base, a hollow housing shell mounted to said base, a shell extension above said base, a guide surface in said shell extension, a carousel in said shell extension, said carousel having a rotatable barrel, a first abrasive pad mounted to said barrel, a second abrasive pad mounted to said barrel, rotation of said barrel selectively disposing each of said first abrasive pad and said second abrasive pad adjacent to said guide surface, and each of said first abrasive pad and said second abrasive pad differing from each other in abrasive characteristics.

2. The sharpener of claim 1 wherein each of said first abrasive pad and second abrasive pad includes a planar portion located adjacent said guide surface when said respective first abrasive pad and said second abrasive pad is selectively disposed at said guide surface, and each of said first abrasive pad and said second abrasive pad being mounted at different angular orientations with respect to said guide surface.

3. The sharpener of claim 2 wherein said barrel includes an upper outwardly extending flange and a lower outwardly extending flange spaced from said upper flange, a set of slots in the lower surface of said upper flange, a set of slots in the upper surface of said lower flange corresponding to said slots in said upper flange, at least one of said slots in said lower flange being offset from its corresponding upper flange slot, and each of said abrasive pads being mounted in a respective slot of said upper flange and a corresponding slot of said lower flange to maintain said pad in a planar condition and at a preset angular orientation.

4. The sharpener of claim 1 wherein a thumb wheel is mounted to said barrel, said barrel including having an internally threaded hole, and a threaded rod threadably engaged in said barrel hole to move said abrasive pads up/down in accordance with the rotation of said thumb wheel.

5. The sharpener of claim 1 including locking projections on opposite sides of said sharpener base for selective insertion into corresponding slots of a storage member to permit said sharpener to be mounted to the storage member, and said shell and said sharpener base being made of a stiff but yieldable resilient material so that upon the squeezing of said shell said locking projections move inwardly to facilitate the selective mounting to and removal of said sharpener from the storage member.

6. The sharpener of claim 1 including a magnet located below said guide surface.

7. The sharpener of claim 1 wherein said pads are magnetized.

8. The sharpener of claim 1 including a hold-down spring mounted above said guide surface and extending toward but spaced from said guide surface for providing a resilient force against a cutting instrument being sharpened.

9. The sharpener of claim 1 including a wedge mounted on said guide surface to form a substitute guide surface.

10. The sharpener of claim 9 wherein said wedge is adjustable to accommodate different sharpening angles.

* * * * *